US006217025B1

(12) United States Patent
Yamazaki et al.

(10) Patent No.: US 6,217,025 B1
(45) Date of Patent: Apr. 17, 2001

(54) GAME APPARATUS

(75) Inventors: Takehiro Yamazaki, Yokohama; Takeshi Takahashi, Hoya, both of (JP)

(73) Assignee: Namco, Ltd., Tokyo (JP)

( * ) Notice: Subject to any disclaimer, the term of this patent is extended or adjusted under 35 U.S.C. 154(b) by 0 days.

(21) Appl. No.: 09/256,299

(22) Filed: Feb. 24, 1999

(30) Foreign Application Priority Data

Feb. 27, 1998 (JP) ..... 10-064207

(51) Int. Cl.[7] ..... A63B 67/00; A63F 7/20

(52) U.S. Cl. ..... 273/340; 273/357; 273/118 A; 273/126 A; 273/108.55; 463/51

(58) Field of Search ..... 273/109, 118 R, 273/118 A, 126 R, 126 A, 129 R, 129 S, 108, 108.54, 108.55, 108.56, 108.57, 108.52, 108.5, 371, 119 R, 340; 463/1, 2, 5, 49–55, 36, 37

(56) References Cited

U.S. PATENT DOCUMENTS 3,781,010 * 12/1973 Matsumoto .
3,901,508 * 8/1975 Spangler .
4,296,929 * 10/1981 Meyer .
4,482,153 * 11/1984 Gibbs .
5,016,890 * 5/1991 Sato .

* cited by examiner

*Primary Examiner*—Sebastiano Passaniti
(74) *Attorney, Agent, or Firm*—Oliff & Berridge PLC.

(57) ABSTRACT

A game apparatus that has a goal corresponding to the number of a player and is designed to cause the player to move a target to the goal in a playing field. The game apparatus has a plurality of tossing devices disposed on the playing field for tossing and moving the movable game piece. Each of the tossing devices includes an impacting member disposed in the playing field to be vertically movable for upwardly tossing the movable game piece, driving devices for tossing the impacting member and a beam sensor located on the impacting member for sensing a beam from a ray gun to energize the driving devices. Adjacent impacting members of the tossing devices toss up the movable game piece in different direction, and there are at least two impacting members under the movable game piece when the movable game piece is on the playing field.

23 Claims, 8 Drawing Sheets

GAME APPARATUS

BACKGROUND OF THE INVENTION

1. Field of the Invention

The present invention relates to a game apparatus, particularly to a game apparatus that moves a movable game piece to a goal on a playing field.

2. Description of the Prior Art

There is known a game apparatus in which a target is to be moved into a given area (e.g., a goal or the like) on a playing field.

Such game apparatuses include a soccer game, for example.

In a soccer game, a plurality of dimples are formed on the playing field, for example, and a ball as a target is brought into any one of these dimples.

The bottom of each of the dimples is provided with two thrusting rods adapted to push the ball toward the competitor's goal.

As the ball enters a dimple, two players depress their respective buttons to manipulate the trusting rods and the ball is moved toward the opponent's goal.

In such a soccer game of the prior art, however, players can not move the ball until the ball reaches the bottom of the dimple.

Thus, players have to wait for some time, resulting in lack of speedy feeling.

In the prior art soccer game, furthermore, only experienced players can appropriately manipulate their respective thrusting rods at a timing just when the ball reaches the bottom of dimple. Since it is difficult for beginners to catch such a timing, they are liable to lose the game and cannot have fun.

SUMMARY OF THE INVENTION

It is therefore an object of the present invention to provide a game apparatus in which a movable game piece can be moved at any time independent of the position of the game piece in a playing field, thereby reducing the waiting time to provide an increased feel of speed.

Another object of the present invention is to provide a game apparatus in which a movable game piece can be moved immediately before it falls on a playing field and which can be played by players without very minding the timing, thereby allowing beginners to fully enjoy the game.

According to one aspect of the present invention, there is provided a game apparatus in which a movable game piece is moved to a goal in a playing field, comprising a plurality of tossing devices disposed in the playing field for tossing and moving the movable game piece, each of the tossing devices including:

an impacting member disposed in the playing field and driven up and down for impacting and tossing the movable game piece; and driving means for driving the impacting member;

wherein adjacent impacting members of the tossing devices toss up the movable game piece in different directions; and wherein there are at least two of the impacting members under the movable game piece when the movable game piece is on the playing field.

The movable game piece is always on the impacting members when it is on the playing field. Thus, the movable game piece can be tossed and moved at any desired time, and players can play a speedy game with a superior response.

Since there are always at least two adjacent impacting members under the movable game piece, the direction of movement of the game piece will not be restricted in contrast to a prior game. By selecting either of the impacting members under the movable game piece, players can choose the direction of movement of the movable game piece.

Each of the tossing devices may be formed as a separate unit, and arranged on the playing field in a matrix form.

In such a case, various separate units previously formed can be located on the playing field to structure any desired game apparatus easily. In such a matrix-like arrangement, further, the units can be disposed on the playing field without gap therebetween.

The impacting members may have a plurality of radially disposed blades. The adjacent impacting members may be disposed such that the blades of different impacting members are alternately arranged. Each of the blades may have an impacting surface that is inclined and tapered outwardly and downwardly.

It is thus ensured that such a tapered impacting surface can toss and move the movable game piece to a plurality of spaced locations in a plurality of directions.

Each of the impacting members may include six of the blades that are symmetrically positioned and the impacting members may be lined up in at least two lines on the playing field.

When each of the impacting members has six symmetrically positioned blades, the impacting members can easily and surely be arranged on the entire playing field in at least two lines without gaps.

At least two goals may be provided at different positions on the playing field. The adjacent blades of different impacting members may impact and toss up the movable game piece in different directions to move the movable game piece toward different goals.

When there are at least two impacting members under the movable game piece, adjacent blades of different impacting members are directed toward different goals. Such a configuration is preferable for a competition game because players can select one of the impacting members that moves in a desired direction.

It is further preferred that at least two goals are opposed to each other in the playing field.

The impacting surface of each of the blades of the impacting member may be movable upwardly to the height higher than the impacting surface of adjacent inactive impacting member.

Since the lowest portion of the impacting surface of the impacting member can be moved to the height higher than the impacting surface of adjacent inactive impacting member, the movable game piece can be surely tossed up when it is not at the lowest level of the playing field. Therefore, the players can play the game without very minding the timing at which the movable game piece is to be moved. The game beginner can fully enjoy the game.

The impacting member and driving means may be located to be separated each other, and the driving means may give an upward impact to the corresponding impacting member to move it upwardly.

Since the driving means and the impacting member are separated, the driving means can toss up the impacting member with a relatively small force. This can increase the fun of the game.

The game apparatus may further comprise a sensor that is provided at the impacting member and used to detect a beam from a ray gun. The driving means may selectively give an upward impact to the corresponding impacting member on the basis of a detection signal from the sensor.

When a player shoots at the sensor by a ray gun, the movable game piece is tossed up as if the player shot the movable game piece itself. This can increase the fun of the game.

The driving means may be selectively actuated by an operating button to selectively toss the impacting member.

In this configuration, the player can enjoy the game by operating the button.

The movable game piece may be a target that is tossed and moved toward a goal by the impacting member.

The use of such a target provides an enjoyable game which is designed to acquire points.

In such a case, the game apparatus may further comprise an anti-goal barrier located immediately before the goal, and the target may be tossed and thrown into the goal beyond the barrier.

The barrier is used to prevent the target form rolling into the goal. By using such a barrier, the fun of the game can further be improved.

The movable game piece may be a prize that is tossed and moved toward the goal by using the impacting member.

Players can try to get a prize and enjoy the game.

According to another aspect of the present invention, there is provided a game apparatus having a goal corresponding to the number of a player who moves a target in a playing field into the goal, the game apparatus comprising:

a plurality of tossing devices disposed in the playing field for tossing and moving the target, each of the tossing devices including:

an impacting member disposed in the playing field and driven up and down for impacting and tossing the target;

driving means for driving the impacting member; and a sensor that is provided at the impacting member and used to detect a beam form a ray gun to actuate the driving means;

wherein adjacent impacting members of the tossing devices toss up the target in different directions;

wherein there are at least two of the impacting members under the target when the target is on the playing field; and wherein the sensor allows the player to selectively actuate the driving means by detecting the beam from the ray gun.

When the players select one of at least two impacting members and shoot at the sensor of it, they can feel as if they shot the target. In this way, they can move the target and enjoy the competition game.

The target is always on the impacting members when it is on the playing field. Thus, the target can be tossed and moved at any desired time, and players can play a speedy game with a superior response.

DESCRIPTION OF THE PREFERRED EMBODIMENTS

One preferred embodiments of the present invention will now be describe in detail with reference to the drawings.

FIGS. 1–12 show a game apparatus constructed according to one embodiment of the present invention.

Figure 1:
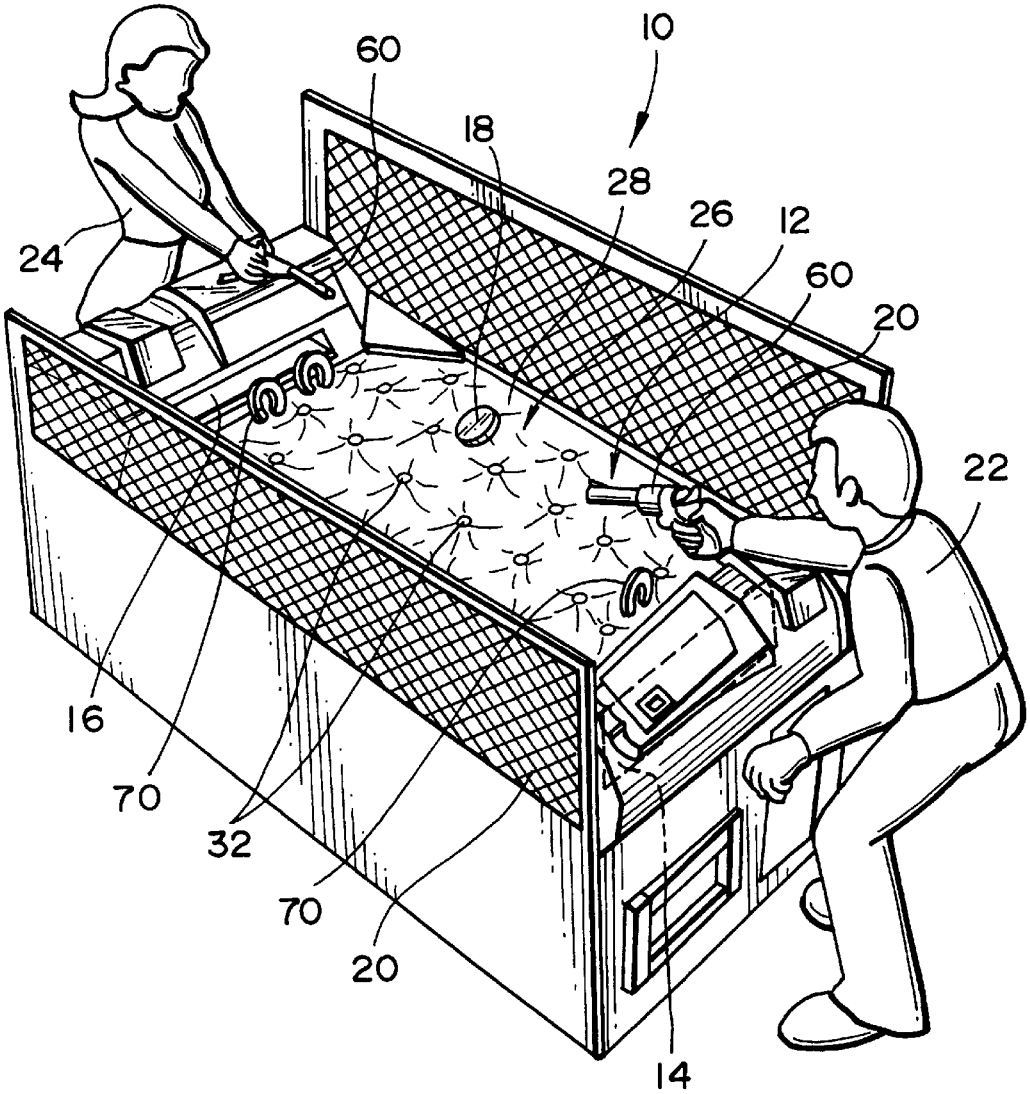
FIG. 1 is a perspective view of the entirety of a game apparatus according to one embodiment of the present invention.

As shown in FIG. 1, the game apparatus 10 of this embodiment has a substantially oblong playing field 12 which is provided with goals 14 and 16 at either end of the playing field 12 as viewed in the longitudinal direction. This means that the game apparatus 10 is a competing game.

The game apparatus 10 also includes upright catch nets 20 which are located on the playing field 12 at either side to prevent a movable game piece or target 18 from bouncing out of the playing field 12.

Two players 22 and 24 stand before the respective ends of the playing field 12 close to the goals 14 and 16 and try to acquire points by tossing and moving the target 18 into the competitor's goal 16 or 14. In this embodiment, the target 18 is a coin which can easily be tossed up. However, the target 18 may take any other form such as an empty can if it can easily be tossed up.

Figure 2:
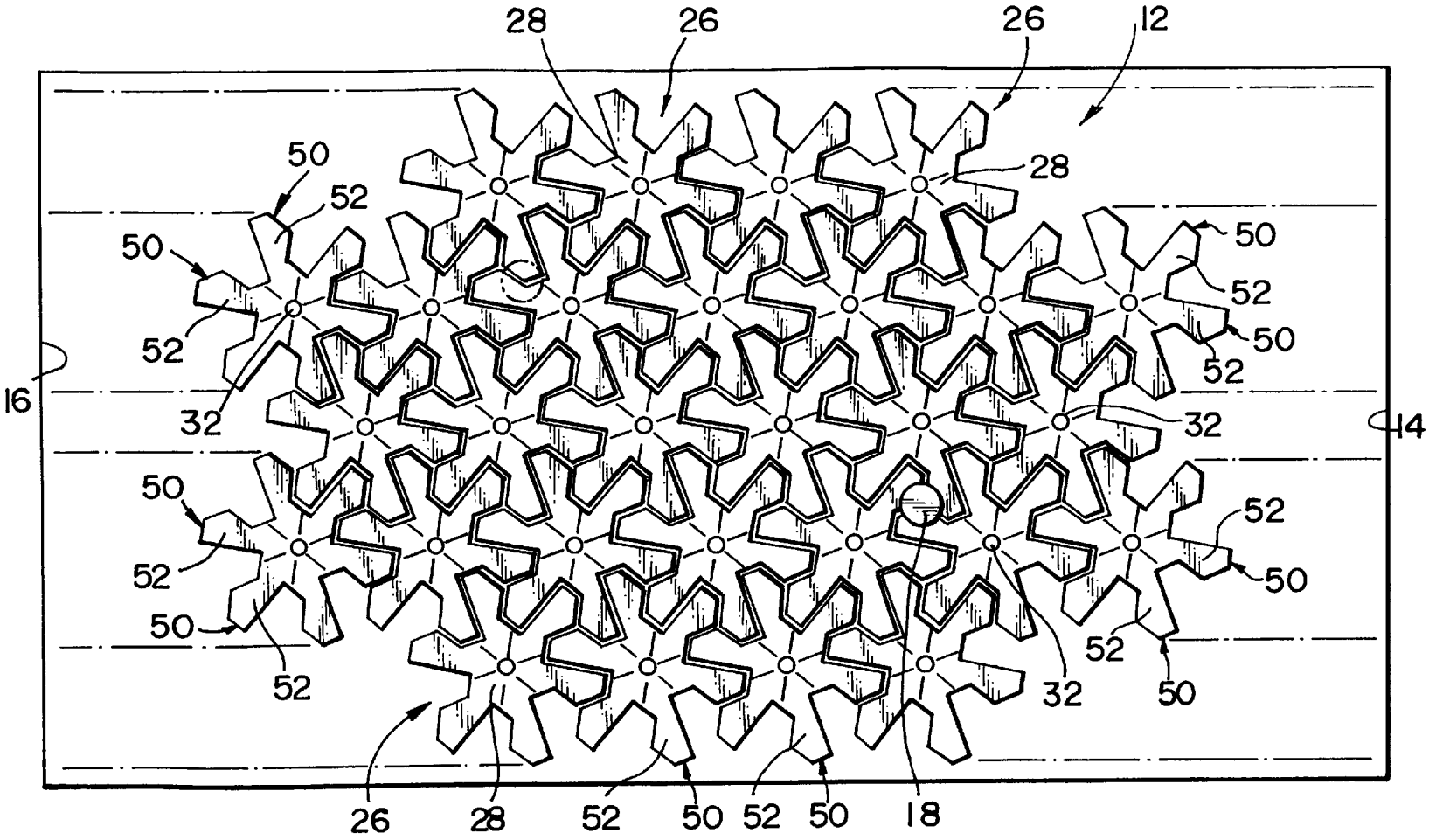
FIG. 2 is an enlarged plan view of the playing field in the game apparatus of FIG. 1.

As can also be seen from FIG. 2, the playing field 12 includes a plurality of tossing devices 26 for tossing and moving the target 18, which are arranged adjacent to one another into a matrix.

Figure 3:
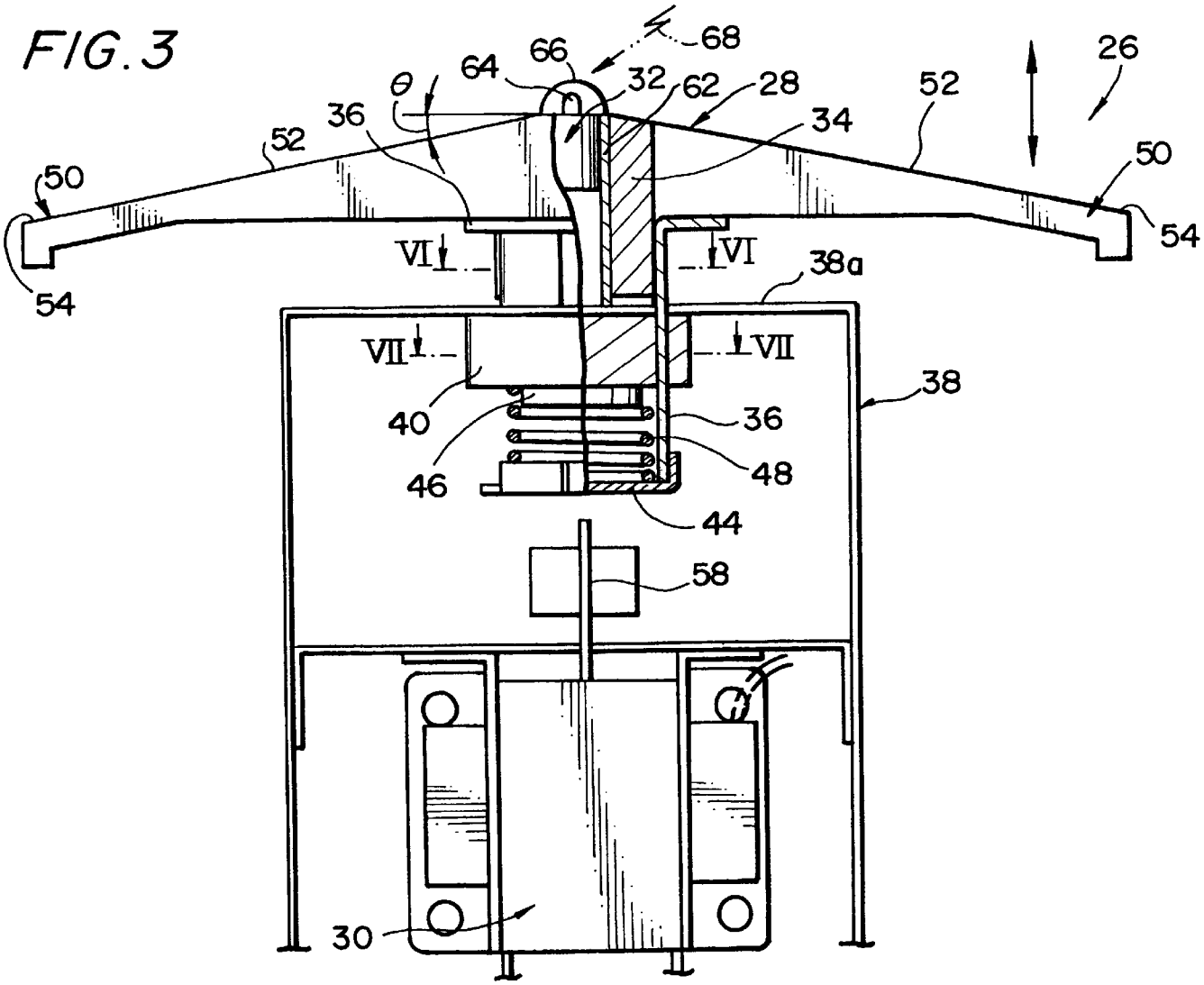
FIG. 3 is an enlarged cross-section of the tossing device in the embodiment.

As shown in FIG. 3, each of the tossing devices 26 is in the form of a single tossing unit which comprises an impacting member 28, a solenoid 30 functioning as driving means and a light receiving sensor 32.

The impacting member 28 can be driven up and down for tossing and moving the target 18 on the playing field 12, and disposed adjacent to the other impacting members 28 on the playing field 12.

Figure 6:
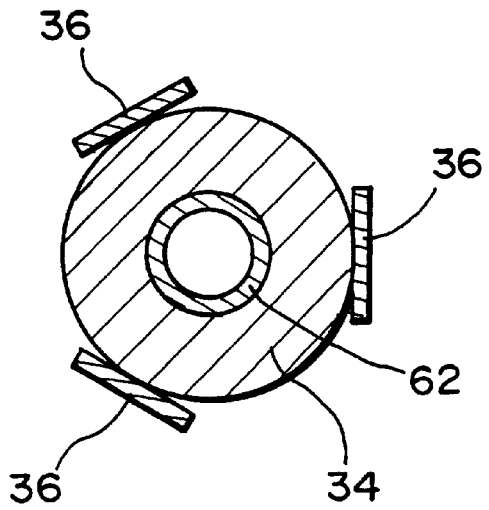
FIG. 6 is a cross-sectional view taken along a line VI—VI in FIG. 3.
Figure 7:
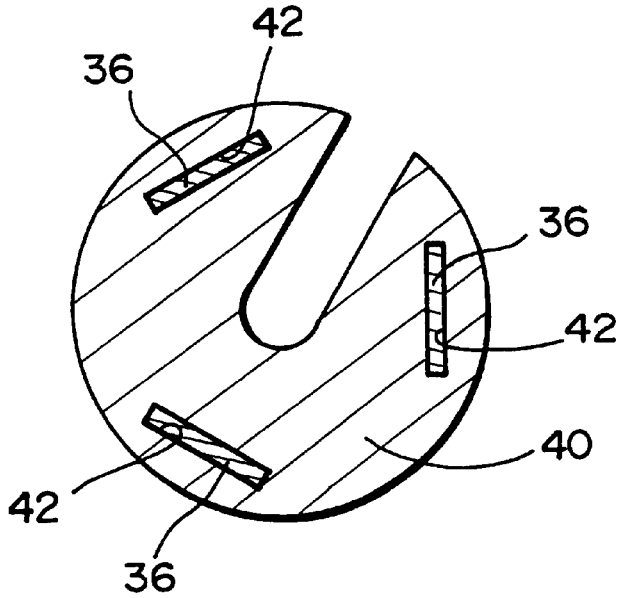
FIG. 7 is a cross-sectional view taken along a line VII—VII in FIG. 3.

More particularly, each impacting member 28 has a tubular shaft 34. As shown in FIGS. 3 and 6, three guide plates 36 of L-shaped cross-section are mounted on the shaft 34 around the outer periphery thereof and spaced apart from one another. These guide plates 36 extend downwardly from the bottom end of the shaft 34.

Each of the three guide plates 36 downwardly extends through the respective one of three through-holes 42 (see FIG. 7) which are formed through a guide block 40 mounted on the bottom of an upper part 38*a* in a mounting frame 38.

The bottom end of each guide plate 36 includes a stopper plate 44 mounted thereon.

The guide plates 36 and guide block 40 function to guide the vertical motion of the impacting member 28 and also to prevent the horizontal rotation of the impacting member 28. At the same time, the stopper plate 44 prevents the impacting member 28 from falling out.

The bottom faces of the shaft and guide block 34, 40 include pads 46 mounted thereon for damping impacts on ascent and descent of the impacting member 28.

A return spring 48 is located between the bottom of the guide block 40 and the top of the stopper plate 44 to return the impacting member 28 to its appropriate position on descent.

Figure 9:
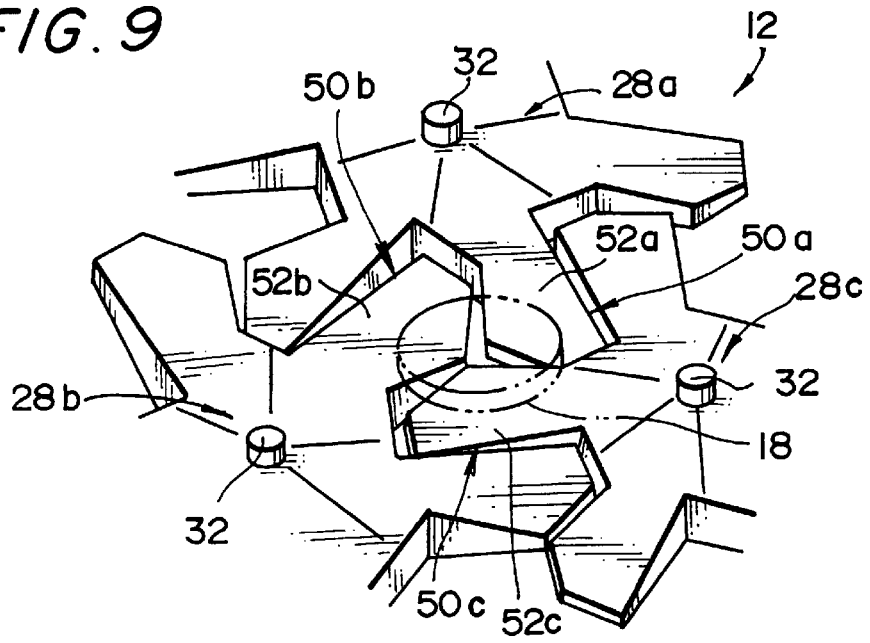
FIG. 9 is a fragmentary perspective view of three impacting members under one target in this embodiment.

As shown in FIGS. 2 and 9, the target 18 is so dimensioned that there are always at least two adjacent impacting members 28 under the target 18 on the playing field 12.

Figure 4:
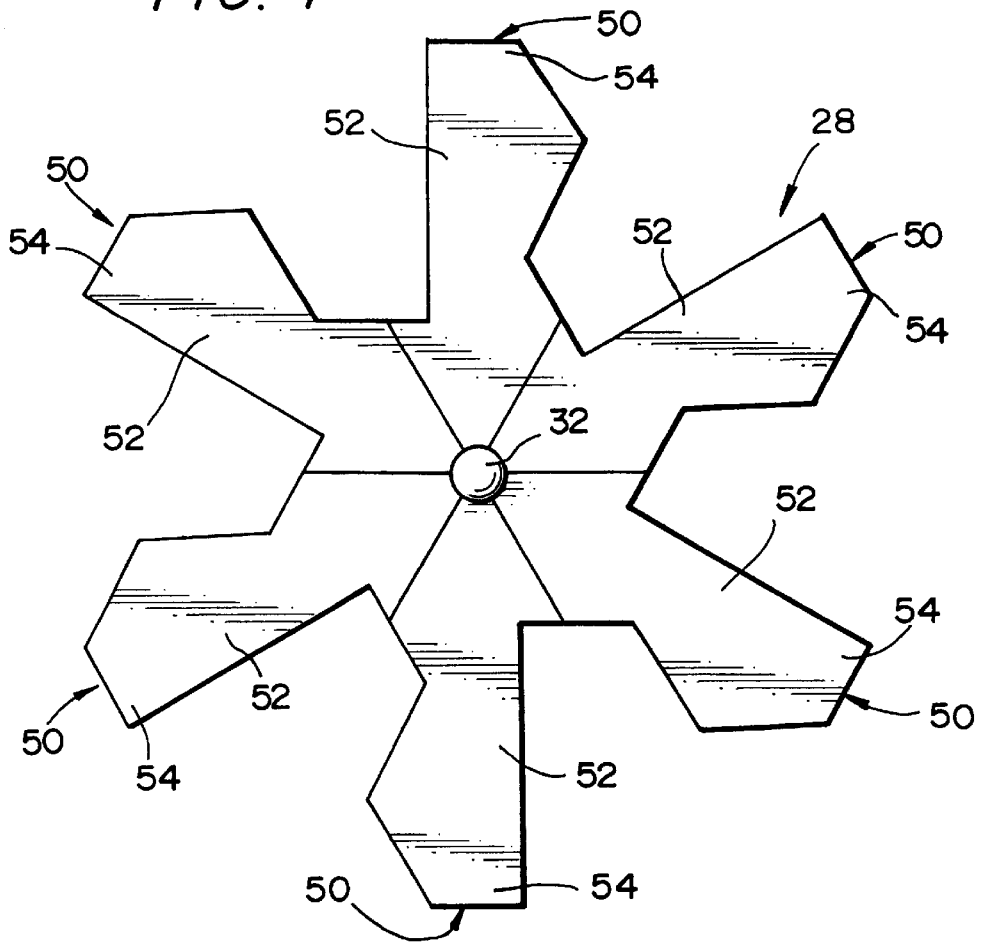
FIG. 4 is a plan view of the impacting member shown in FIGS. 2 and 3.
Figure 5:
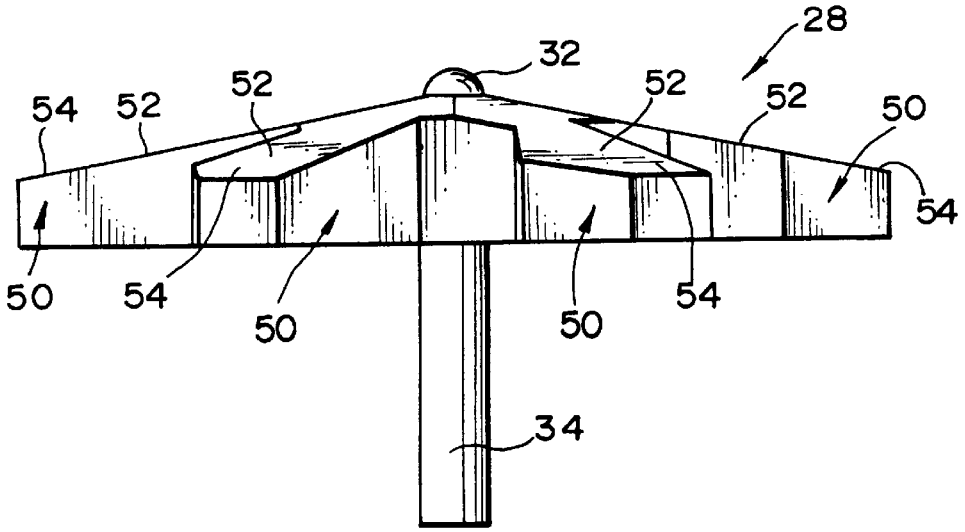
FIG. 5 is a side view of the impacting member shown in FIG. 4.

More particularly, the impacting member 28 comprises six blades 50 radially extending from the outer periphery of the shaft 34, as shown in FIGS. 4 and 5. The impacting members 28 are arranged in such a closely aligned matrix pattern that the blades 50 of different impacting members 28 are alternately arranged, as shown in FIG. 2.

Thus, two players 22 and 24 can select and operate either of the at least two impacting members 28 under the target 18 to toss and move the target 18 at any time. This provides a game having an improved response.

Each of the blades 50 in the impacting member 28 includes a tapered top impacting surface 52 inclined outwardly and downwardly with a given angle θ, as shown in FIG. 3.

The impacting surface 52 in the impacting member 28 functions not only to toss the target 18 merely upwardly, but also to move the target 18 in a given direction to be away from the impacting member 28.

All the six blades 50 on the impacting member 28 are directed not to extend from the shaft 34 in a direction perpendicular to the longitudinal axis of the playing field 12, as shown in FIG. 2. As the target 18 is upwardly tossed by any one of the six blades 50, the tossed target 18 will be moved to approach any one of the goals. In the present embodiment, particularly, the adjacent blades 50 in the adjacent impacting members 28 are designed to toss up the target 18 in different directions. More particularly, one of the adjacent blades 50 of adjacent impacting members 28 tosses and moves the target 18 toward one of the goals 14 and 16, and the other of the adjacent blades 50 tosses and moves the target 18 toward the other of the goals 14 and 16.

In such a manner, each of the players 22 and 24 can selectively drive the impacting member 28 directed to the competitor's goal 16 or 14 to toss and move the target 18 thereto.

Figure 8:
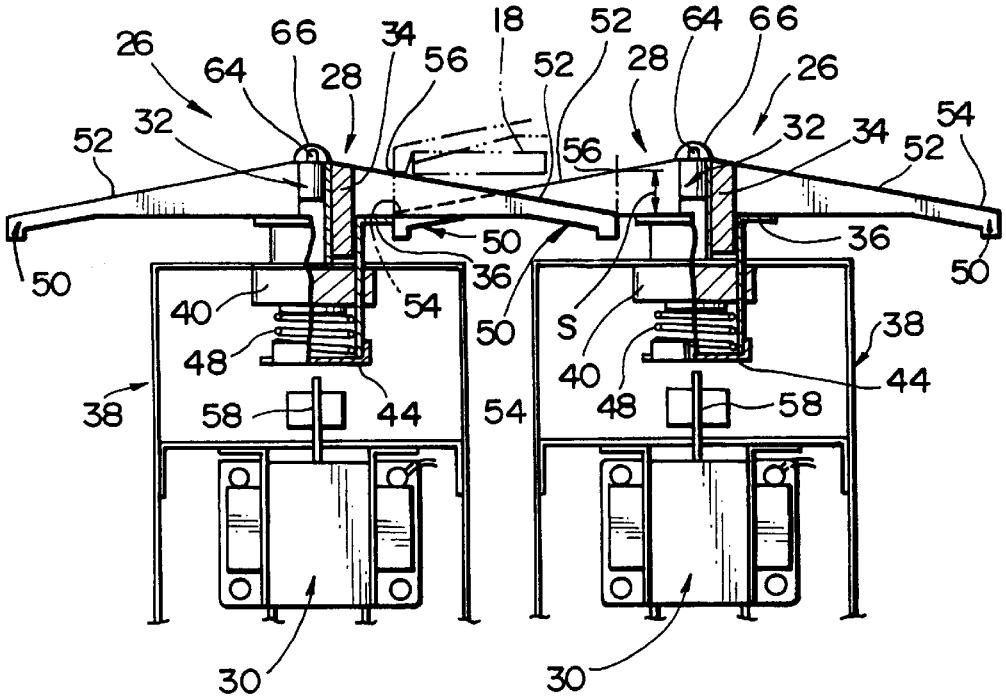
FIG. 8 is a cross-sectional view of the impacting members of two adjacent tossing devices in this embodiment.

As can be seen from FIG. 8, the impacting member 28 has such a stroke S that the lowest portion of the impacting surface 52 in that impacting member 28 is movable upwardly to the height higher than the impacting surface 52 of the adjacent intermeshed inactive impacting member 28.

Thus, even when the target 18 is at a portion 56 of the impacting surface 52 of one impacting member 28 and in non-contact with the impacting surface 52 of any other adjacent impacting member 28, the target 18 can upwardly be tossed by the lowest portion 54 of the impacting surface 52 of the adjacent impacting member 28 by upwardly bouncing the last-mentioned impacting member 28. Therefore, the target 18 can always be tossed and moved by selecting and driving any one of the at least two adjacent impacting members 28.

In addition, the target 18 can be again tossed up by the lowest portion 54 of the impacting surface 52 of the impacting member 28 even before the previously tossed target 18 falls on the lowest level on the playing field.

The solenoid 30 functions to toss the corresponding impacting member 28 and is in the form of AC solenoid in the embodiment. As shown in FIG. 3, the solenoid 30 is mounted on the mounting frame 38 such that its plunger 58 is located below the stopper plate 44.

The solenoid 30 is located separately of the corresponding impacting member 28. As the solenoid 30 is energized the plunger 58 thereof is banged against the bottom of the corresponding stopper plate 44 to produce such an impact that the impacting member 28 is upwardly tossed.

In such an arrangement, the kinetic energy in the solenoid 30 is transmitted to the impacting member 28, so that it can be tossed up with a relatively small force.

The light receiving sensor 32 functions to energize the solenoid 30 when the sensor 32 receives a light beam from a ray gun held by the player 22 or 24. As shown in FIG. 3, the light receiving sensor 32 is mounted within the shaft 34 of the corresponding impacting member 28 so that the light receiving portion 64 thereof is exposed at the top of a sleeve 62 also mounted within the same shaft 34. Thus, the light receiving portion 64 of the sensor 32 can easily receive the light beam 68.

The light receiving portion 64 is covered with a transparent cover 66 so that the light receiving portion 64 will not be damaged by direct impact with the target 18.

The light beam 68 from the ray gun 60 is a visible light ray emitted from a xenon lamp. As the ray gun is triggered, the visible light ray is emitted therefrom to visibly confirm whether or not the shot hits the target.

The playing field 12 includes barriers 70 located in front of the goals 14 and 16 for prevent the target 18 from rolling into the respective one of the goals 14 and 16. Thus, the target 18 must be tossed up in front of the barriers 70 to be thrown into the goal 14 or 16.

The game apparatus 10 will now be described in operation

Two players 22 and 24 stand before the goals 14 and 16 of the playing field 12 while holding the respective ray guns 60 and then throw a coin into a coin slot.

When either of the player 22 or 24 depresses an entry button, the game will be started.

If the target 18 used in the previous play remains on the playing field 12, for example, the players 22 or 24 may trigger its own ray gun 60 for ten seconds before the game is actually started. As a result, the player 22 or 24 can perform a test shooting while returning the target into the goal 14 or 16.

After the target 18 has been returned into the goal 14 or 16 within ten seconds, the returned target 18 is again thrown onto the playing field 12 and then the actual game will be started.

If the target 18 has not been returned into the goal 14 or 16 within ten seconds, the game is automatically started while the target 18 used in the previous play remains on the playing field 12.

After starting of the game, the players 22 and 24 compete against each other to acquire points by tossing the target 18 into the competitor's goal 14 or 16 within a given period of time.

During play of the game, the players 22 and 24 irradiate the light beams 68 from their own ray guns 60 toward the playing field 12 under the target 18.

In such a case, each player selects one of the impacting members 28 and irradiates the light beam from the ray gun 60 to the light receiving portion 64 of the light receiving sensor 32 in the selected impacting member 28 since there are at least two adjacent impacting members 28 under the target 18 at all times.

As the light receiving portion 32 of the impacting member 28 receives the light beam 68 from the ray gun 60, the light receiving sensor 32 generates an operating signal which is in turn fed to the corresponding solenoid 30. In response to the signal, the solenoid 30 is energized to cause the plunger 58 thereof to impact the bottom of the stopper plate 44, thereby upwardly moving the corresponding impacting member 28.

In this case, the impact is transmitted from the plunger 58 to the impacting member 28 through the stopper and guide plates 44, 36, so that the impacting member 28 will be moved upwardly into abutment of the stopper plate 44 with the pad 46 on the bottom of the guide block 40 against the bias of the return spring 48. As a result, the corresponding impacting member 28 will toss the target 18 upwardly.

As the impacting member 28 is guided by the guide block 40 and guide plate 36, it can upwardly be tossed without rotation. Thereafter, the impacting member 28 will downwardly be moved properly to its original position under the action of the return spring 48.

The impacting member 28 is selected in such a manner as shown in FIGS. 9–12.

For example, FIG. 9 shows that there are three blades 50*a*. 50*b* and 50*c* in three adjacent impacting member 28*a*, 28*b* and 28*c* under the target 18.

Figure 10:
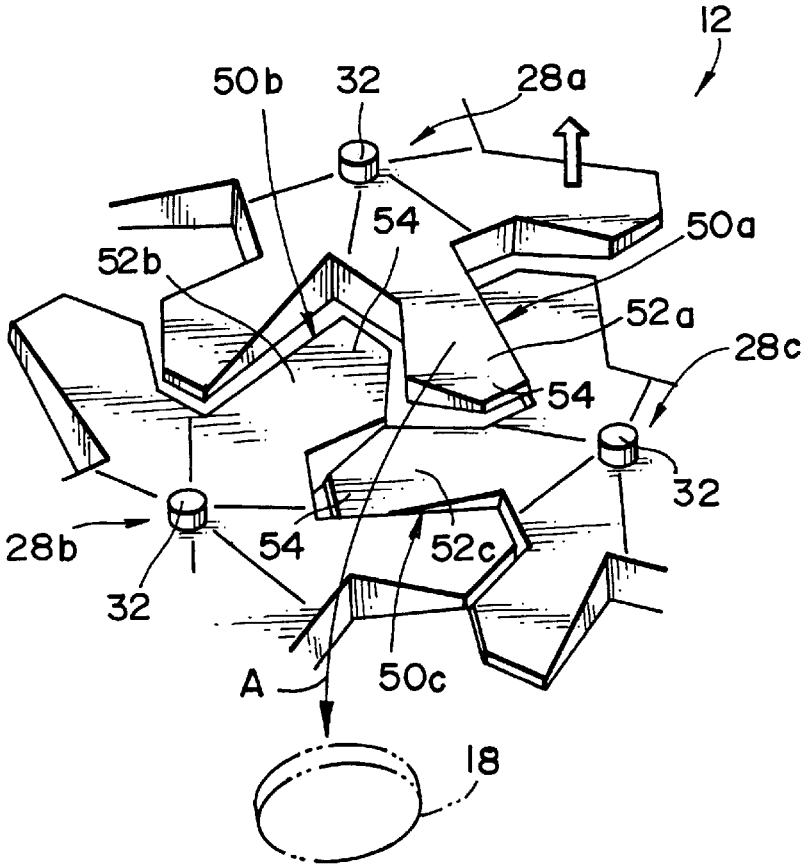
FIG. 10 is a fragmentary perspective view similar to FIG. 9 with one impacting member being upwardly moved from the position of FIG. 9.

As one of these impacting member 28*a* is driven in such a state, the target 18 will be tossed and moved by the impacting surface 52*a* of the blade 50*a* in a direction of arrow A as shown in FIG. 10.

Figure 11:
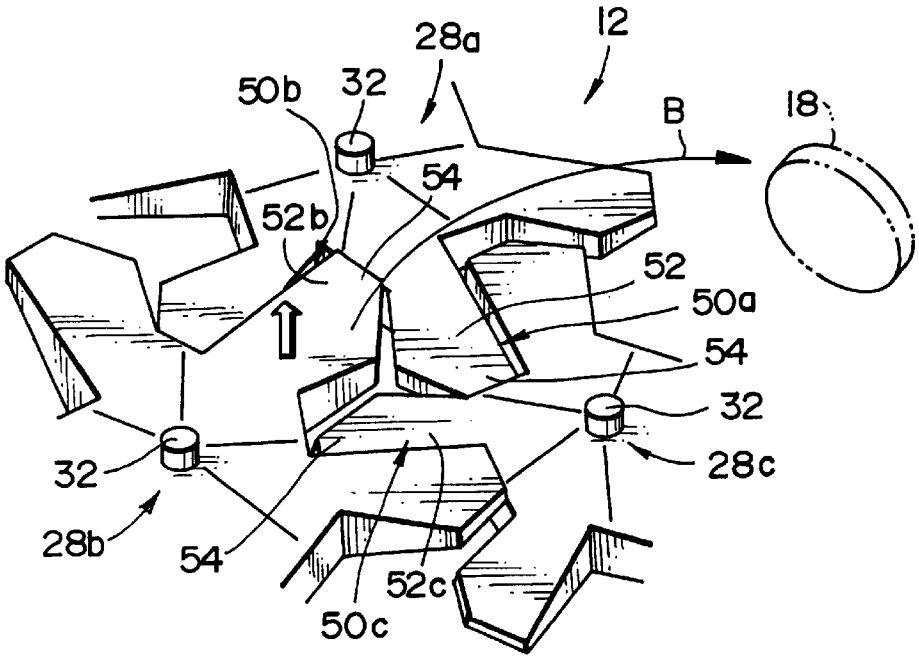
FIG. 11 is a fragmentary perspective view similar to FIG. 9 with another impacting member being upwardly moved from the position of FIG. 9.

As another impacting member 28*b* is driven, the target 18 will be tossed and moved by the impacting surface 52*b* of the blade 50*b* in a direction of arrow B as shown in FIG. 11.

Figure 12:
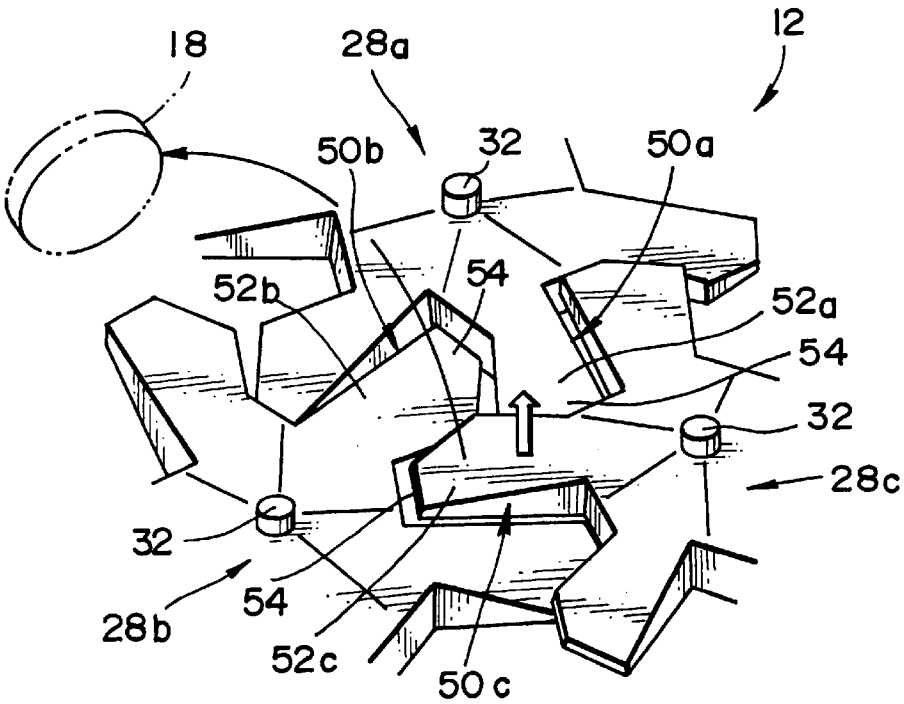
FIG. 12 is a fragmentary perspective view similar to FIG. 9 with still another impacting member being upwardly moved from the position of FIG. 9.

As still another impacting member 28 is driven, the target 18 will be tossed and moved by the impacting surface 52*c* of the blade 50*c* in a direction of arrow C as shown in FIG. 12.

Thus, each of the players 22 or 24 selects any one of the three impacting members 28*a*, 28*b* or 28*c* which can move the target 18 in the desired direction, and shoots the light receiving sensor on the selected impacting member 28*a*, 28*b* or 28*c* by the ray gun to put the target 18 to the competitor's goal 14 or 16.

In such a manner, the two players 22 and 24 can toss and move the target 18 toward the barrier 70 in front of the competitor's goal and further toss the target in front of that barrier 70 so that the target will enter the goal 14 or 16 beyond the barrier 70 to acquire a point.

Such a matter will repeated within a given limited period of time to compete points.

The present invention is not limited to the aforementioned embodiment, but may be carried out in any of various other forms within the concept and scope of the present invention.

Although the aforementioned embodiment has been described as to the competition game using a target as a movable game piece, the present invention may be applied to a game in which a prize such as a doll is to be tossed and moved to a getting position, a game in which a prize is to be tossed into a particular goal, a game in which a prize is moved to a goal in a stepped playing field, or the like.

Although the movable game piece has been described as to a coin-like target, the movable game piece may take any of various other movable game pieces of different shape and size if it will not penetrate into the gap between the adjacent impacting members.

Although the playing field has been described as to the substantially oblong configuration, the present invention may take any playing field of different shape and size by changing the number of impacting members.

Although the tossing devices have been described as to a tossing unit, they are not necessarily structured into such a unit and may be formed by assembling individual parts on the playing field.

Although the impacting members have been described as to having six blades, the number of blades may be changed to three or four if they can closely be bedded on the playing field and move the movable game piece to the desired direction.

Although the aforementioned embodiment has been described as to the impacting member is tossed up by the driving means without rotation, they may be bounced up while being rotated.

Although the driving means has been described as to AC solenoid, it may be in the form of DC solenoid or air cylinder or lever means.

Although the light receiving sensors have been described as to receiving the visible light ray emitted from the xenon lamp, it may be in the form of a sensor for sensing infrared rays or ultrasonic waves.

The driving means may be energized to selectively toss the impacting members by selectively actuating operating buttons. This provides a game which can be enjoyed by players using the operating buttons.

What is claimed is:

1. A game apparatus in which a movable game piece is moved to a goal in a playing field, comprising a plurality of tossing devices disposed in said playing field for tossing and moving said movable game piece, each of said tossing devices including:

an impacting member disposed in said playing field and driven up and down for impacting and tossing said movable game piece; and driving means for driving said impacting member;

wherein adjacent impacting members of said tossing devices toss up said movable game piece in different directions; and wherein said impacting members are shaped and arranged such that at least two of adjacent impacting members are intermeshed.

2. The game apparatus as defined in claim 1, wherein each of said tossing devices is formed as a separate unit, said tossing devices being arranged on said playing field in a matrix form.

3. The game apparatus as defined in claim 1, wherein said impacting member has a plurality of radially disposed blades;

wherein adjacent impacting members are disposed such that said blades of different impacting members are alternately arranged; and wherein each of said blades has an impacting surface that is inclined and tapered outwardly and downwardly.

4. The game apparatus as defined in claim 3, wherein each of said impacting members includes six of said blades that are symmetrically positioned, said impacting members being lined up in at least two lines on the playing field.

5. The game apparatus as defined in claim 4, wherein at least two goals are provided at different positions on said playing field; and wherein said adjacent blades of different impacting members impact and toss up said movable game piece in different directions to move said movable game piece toward different goals.

6. The game apparatus as defined in claim 4, wherein said impacting surface of each of said blades of said impacting member is movable upwardly to the height higher than said impacting surface of adjacent inactive impacting member.

7. The game apparatus as defined in claim 3, wherein at least two goals are provided at different positions on said playing field; and wherein said adjacent blades of different impacting members impact and toss up said movable game piece in different directions to move said movable game piece toward different goals.

8. The game apparatus as defined in claim 7, wherein said impacting surface of each of said blades of said impacting member is movable upwardly to the height higher than said impacting surface of adjacent inactive impacting member.

9. The game apparatus as defined in claim 3, wherein said impacting surface of each of said blades of said impacting member is movable upwardly to the height higher than said impacting surface of adjacent inactive impacting member.

10. The game apparatus as defined in claim 3, further comprising an anti-goal barrier located immediately before said goal; and wherein said target is tossed and thrown into said goal beyond said barrier.

11. The game apparatus as defined in claim 1, wherein said impacting member and driving means are located to be separated from each other; and wherein said driving means gives an upward impact to the corresponding impacting member to move said impacting member upwardly.

12. The game apparatus as defined in claim 1, further comprising a sensor that is provided at said impacting member and used to detect a beam from a ray gun;

wherein said driving means selectively gives an upward impact to the corresponding member on the basis of a detection signal from said sensor.

13. The game apparatus as defined in claim 1, wherein said driving means is selectively actuated by an operating button to selectively toss said impacting member.

14. The game apparatus as defined in claim 1, wherein said movable game piece is a target that is tossed and moved toward a goal by said impacting member.

15. The game apparatus as defined in claim 1, wherein said movable game piece is a prize that is tossed and moved toward said goal by using said impacting member.

16. A game apparatus having a goal corresponding to the number of a player who moves a target in a playing field into said goal, said game apparatus comprising:

a plurality of tossing devices disposed in said playing field for tossing and moving said target, each of said tossing devices including:

an impacting member disposed in said playing field and driven up and down for impacting and tossing said target;

driving means for driving said impacting member; and a sensor that is provided at said impacting member and used to detect a beam from a ray gun to actuate said driving means;

wherein adjacent impacting members of said tossing devices toss up said target in different directions;

wherein there are at least two of said impacting members under said target when said target is on said playing field; and wherein said sensor allows said player to selectively actuate said driving means by detecting said beam from said ray gun.

17. The game apparatus as defined in claim 16, wherein each of said tossing devices is formed as a separate unit, said tossing devices being arranged on said playing field in a matrix form.

18. The game apparatus as defined in claim 16, wherein said impacting member has a plurality of radially disposed blades;

wherein adjacent impacting members are disposed such that said blades of different impacting members are alternately arranged; and wherein each of said blades has an impacting surface that is inclined and tapered outwardly and downwardly.

19. The game apparatus as defined in claim 18, wherein each of said impacting members includes six of said blades that are symmetrically positioned, said impacting members being lined up in at least two lines on the playing field.

20. The game apparatus as defined in claim 19, wherein at least two goals are provided at different positions on said playing field; and wherein said adjacent blades of different impacting members impact and toss up said target in different directions to move said target toward different goals.

21. A game apparatus in which a movable game piece is moved to a goal in a playing field, comprising:

a plurality of tossing devices disposed in said playing field for tossing and moving said movable game piece, each of said tossing devices including:

an impacting member disposed in said playing field and driven up and down for impacting and tossing said movable game piece;

driving means for driving said impacting member;

wherein adjacent impacting members of said tossing devices toss up said movable game piece in different direction; and wherein there are at least two of said impacting members under said movable game piece when said movable game piece is on said playing field;

wherein said impacting member and driving means are located to be separated from each other; and wherein said driving means gives an upward impact to the corresponding impacting member to move said impacting member upwardly.

22. A game apparatus in which a movable game piece is moved to a goal in a playing field, comprising:

a plurality of tossing devices disposed in said playing field for tossing and moving said movable game piece, each of said tossing devices including;

an impacting member disposed in said playing field and driven up and down for impacting and tossing said movable game piece;

a sensor that is provided at said impacting member and used to detect a beam from a ray gun; and driving means for driving said impacting member wherein said driving means selectively gives an upward impact to the corresponding member on the basis of a detection signal from said sensor;

wherein adjacent impacting members of said tossing devices toss up said movable game piece in different directions; and wherein there are at least two of said impacting members under said movable game piece when said movable game piece is on said playing field.

23. A game apparatus, comprising:

a movable game piece which is moved to a goal in a playing field, said movable game piece being a target that is tossed and moved toward a goal by said impacting member;

an anti-goal barrier located immediately before said goal, said target being tossed and thrown into said goal beyond said barrier;

a plurality of tossing devices disposed in said playing field for tossing and moving said movable game piece, each of said tossing devices including:

an impacting member disposed in said playing field and driven up and down for impacting and tossing said movable game piece; and driving means for driving said impacting member;

wherein adjacent impacting members of said tossing devices toss up said movable game piece in different directions; and wherein there are at least two of said impacting members under said movable game piece when said movable game piece is on said playing field.

* * * * *